US008131205B2

(12) United States Patent
Rosen

(10) Patent No.: US 8,131,205 B2
(45) Date of Patent: Mar. 6, 2012

(54) MOBILE PHONE DETECTION AND INTERRUPTION SYSTEM AND METHOD

(76) Inventor: Michael Rosen, Akron, OH (US)

( * ) Notice: Subject to any disclaimer, the term of this patent is extended or adjusted under 35 U.S.C. 154(b) by 311 days.

(21) Appl. No.: 12/433,219

(22) Filed: Apr. 30, 2009

(65) Prior Publication Data

US 2009/0275281 A1 Nov. 5, 2009

Related U.S. Application Data

(60) Provisional application No. 61/049,610, filed on May 1, 2008.

(51) Int. Cl.
*H04K 3/00* (2006.01)

(52) U.S. Cl. ..... 455/1; 455/569.2; 455/73; 455/414.1; 455/550.1

(58) Field of Classification Search ..... 455/456, 455/418, 569.2, 414.1, 445, 1; 701/36
See application file for complete search history.

(56) References Cited

U.S. PATENT DOCUMENTS

| | | | | |
|---|---|---|---|---|
| 5,295,180 | A | 3/1994 | Vendetti | |
| 5,515,042 | A | 5/1996 | Nelson | |
| 5,636,265 | A | 6/1997 | O'Connell | |
| 5,655,019 | A | 8/1997 | McKernan | |
| 5,935,190 | A | 8/1999 | Davis et al. | |
| 5,948,038 | A | 9/1999 | Daly et al. | |
| 6,121,898 | A | 9/2000 | Moetteli | |
| 6,195,529 | B1 | 2/2001 | Linz | |
| 6,381,533 | B1 | 4/2002 | Crane et al. | |
| 6,393,254 | B1 | 5/2002 | Pousada Carballo et al. | |
| 6,393,301 | B1 | 5/2002 | Oda | |
| 6,422,713 | B1 | 7/2002 | Fohl et al. | |
| 6,502,022 | B1 * | 12/2002 | Chastain et al. | 701/36 |
| 6,542,730 | B1 | 4/2003 | Hosain | |
| 6,556,810 | B2 * | 4/2003 | Suzuki | 455/88 |
| 6,643,517 | B1 | 11/2003 | Steer | |
| 6,687,497 | B1 | 2/2004 | Parvulescu et al. | |
| 6,687,506 | B1 | 2/2004 | Girod | |
| 6,701,158 | B2 | 3/2004 | Moreth | |
| 6,720,889 | B2 | 4/2004 | Yamaki et al. | |
| 6,728,542 | B2 * | 4/2004 | Meda | 455/445 |
| 6,741,165 | B1 | 5/2004 | Langfahl et al. | |
| 6,758,089 | B2 | 7/2004 | Breed et al. | |
| 6,771,946 | B1 | 8/2004 | Oyaski | |

(Continued)

FOREIGN PATENT DOCUMENTS

DE 198 07 825 A1 9/1999

OTHER PUBLICATIONS

Sundeen, "Cell Phones And Highway Safety", 2005 State Legislative Update, Aug. 2005, National Conference of State Legislatures, Denver Colorado.

(Continued)

*Primary Examiner* — Jinsong Hu
*Assistant Examiner* — Benjamin Morales Fernandez
(74) *Attorney, Agent, or Firm* — Christopher L. Parmelee; Walker & Jocke

(57) ABSTRACT

A mobile phone detection and interruption system and method are provided. The system is operative to transmit different blocking signals capable of degrading or blocking mobile phone communication in a vehicle responsive to a velocity of the vehicle reaching different pre-configured velocity levels.

9 Claims, 2 Drawing Sheets

U.S. PATENT DOCUMENTS

| | | | | |
|---|---|---|---|---|
| 6,782,240 | B1 | 8/2004 | Tabe | |
| 6,803,854 | B1 | 10/2004 | Adams et al. | |
| 6,810,321 | B1 | 10/2004 | Cook | |
| 6,914,541 | B1 | 7/2005 | Zierden | |
| 6,922,571 | B1 | 7/2005 | Kinoshita | |
| 6,970,102 | B2 | 11/2005 | Ciolli | |
| 6,973,333 | B1 | 12/2005 | O'Neil | |
| 6,985,827 | B2 | 1/2006 | Williams et al. | |
| 7,027,619 | B2 | 4/2006 | Pavlidis et al. | |
| 7,123,874 | B1 | 10/2006 | Brennan | |
| 7,181,229 | B2 | 2/2007 | Singh | |
| 7,187,952 | B2 | 3/2007 | Lin | |
| 7,187,953 | B2 * | 3/2007 | Bauchot et al. | 455/569.2 |
| 7,292,848 | B2 | 11/2007 | Mazzara, Jr. | |
| 7,301,494 | B2 | 11/2007 | Waters | |
| 7,646,422 | B2 | 1/2010 | Kisacanin et al. | |
| 7,876,205 | B2 | 1/2011 | Catten et al. | |
| 2001/0044312 | A1 * | 11/2001 | Yamane | 455/456 |
| 2001/0050614 | A1 | 12/2001 | Yang | |
| 2003/0137408 | A1 | 7/2003 | Breiner | |
| 2004/0077339 | A1 | 4/2004 | Martens | |
| 2004/0198306 | A1 | 10/2004 | Singh | |
| 2004/0246139 | A1 | 12/2004 | Harris | |
| 2005/0215241 | A1 | 9/2005 | Okada | |
| 2005/0255874 | A1 | 11/2005 | Stewart-Baxter et al. | |
| 2006/0055561 | A1 | 3/2006 | Kamali et al. | |
| 2006/0099940 | A1 * | 5/2006 | Pfleging et al. | 455/419 |
| 2006/0105701 | A1 | 5/2006 | Cornwell | |
| 2006/0252432 | A1 | 11/2006 | Gruchala | |
| 2006/0286930 | A1 | 12/2006 | Rathus et al. | |
| 2007/0026850 | A1 * | 2/2007 | Keohane et al. | 455/418 |
| 2007/0035384 | A1 * | 2/2007 | Belcher et al. | 340/425.5 |
| 2007/0254632 | A1 | 11/2007 | Beadle | |
| 2007/0281603 | A1 * | 12/2007 | Nath et al. | 455/1 |
| 2007/0290535 | A1 * | 12/2007 | Meredith et al. | 297/217.1 |
| 2008/0043993 | A1 | 2/2008 | Johnson | |
| 2008/0064446 | A1 * | 3/2008 | Camp et al. | 455/565 |
| 2009/0215387 | A1 * | 8/2009 | Brennan et al. | 455/1 |
| 2010/0035632 | A1 | 2/2010 | Catten | |
| 2010/0238065 | A1 | 9/2010 | Pitt et al. | |

OTHER PUBLICATIONS

Strayer, et al., "A Comparison of the Cell Phone Driver and the Drunk Driver", Human Factors, Summer 2006, pp. 381-391, vol. 48, No. 2, Human Factors and Ergonomics Society, Salt Lake City, UT.

Stutts, et al., "Distractions in Everyday Driving", Jun. 2003, AAA Foundation for Traffic Safety, Washington DC.

Wisniewski, "Assembley, No. 3939", Dec. 11, 2003, State of New Jersey.

"Senate Bill No. 1613", Sep. 15, 2006, State of California.

"Raised Bill No. 5553", Feb. 2004, State of Connecticut.

"An Act", Spring 2004, District of Columbia.

"2006 Annual Report", 2006, Quixote Corporation.

"Annual Report 2005", 2005, Redflex Holdings Limited.

Qingli Liu, et al., "A Unified MLSE Detection Technique for TDMA Digital Cellular Radio", IEEE, 1993, pp. 265-268.

* cited by examiner

102

200 220

| Blocking Type | Velocity Level |
|---|---|
| No Blocking | < 15 miles/hour |
| Periodic Blocking | 15 – 25 miles/hour |
| Full Blocking | > 25 miles/hour |

FIG. 2

MOBILE PHONE DETECTION AND INTERRUPTION SYSTEM AND METHOD

CROSS REFERENCE TO RELATED APPLICATIONS

This application claims benefit pursuant to 35 U.S.C. §119 (e) of provisional applications 61/049,610 filed May 1, 2008, which is hereby incorporated by reference herein.

BACKGROUND

As mobile telephones have come into widespread use, people often use their mobile phones while driving vehicles. However, mobile phone usage by the driver of a vehicle can significantly distract the driver's attention from driving-related tasks. As a result, mobile phone use while driving can significantly increase the risk of traffic violations and driving accidents.

Accordingly, it is desirable to provide a system and method which is operative to assist in decreasing traffic violations and driving accidents caused by mobile phone use while driving.

BRIEF SUMMARY

It is an aspect of at least one embodiment of at least one invention described herein to provide a system and method which is operative to assist in decreasing traffic violations and driving accidents caused by mobile phone use while driving.

It is a further aspect of at least one embodiment of at least one invention described herein to provide a system and method which is operative to assist in decreasing problems associated with mobile phone use in non-driving environments.

The foregoing aspects may be accomplished in at least one example embodiment by a system that includes a mobile phone communication detection and blocking system capable of being mounted in a vehicle and is capable of blocking communications between a mobile phone and a cellular network responsive to the velocity of the vehicle and/or the detection of mobile phone communications in the vehicle. In an example embodiment, the system is capable of selectively interrupting the mobile phone communication with a plurality of different types of blocking signals including: blocking signals that degrade a mobile phone call by periodically interrupting the communication; and blocking signals that fully interrupt a call and force the mobile phone communication to stop via a dropped call. In this described embodiment, the system may be user configurable to enable the system to output different types of blocking signals responsive to user configurable velocity levels (e.g. velocity ranges and/or thresholds) for the vehicle.

In another embodiment, the system may be used in a prison environment in which individual systems are placed in each prison cell or a group of adjacent prison cells. Each of the systems may include a wireless or wired network interface capable of communicating with a remote server. Upon detection of a mobile phone communication in a particular cell, the particular system may be configured to transmit a full blocking signal to force the call to be dropped. In addition, the system may be configured to communicate with the server and provide information usable by the server to determine which prison cell attempted mobile phone communication. The server may then output an alarm or otherwise notify prison personal so that the mobile phone can be located and removed from the prison cell.

Further aspects and examples of embodiments of at least one invention described herein will be made apparent in the following Detailed Description and the appended claims.

BRIEF DESCRIPTION OF DRAWINGS

FIG. 2 is a schematic view of configuration information stored in a memory device of the system.

DETAILED DESCRIPTION

Figure 1:
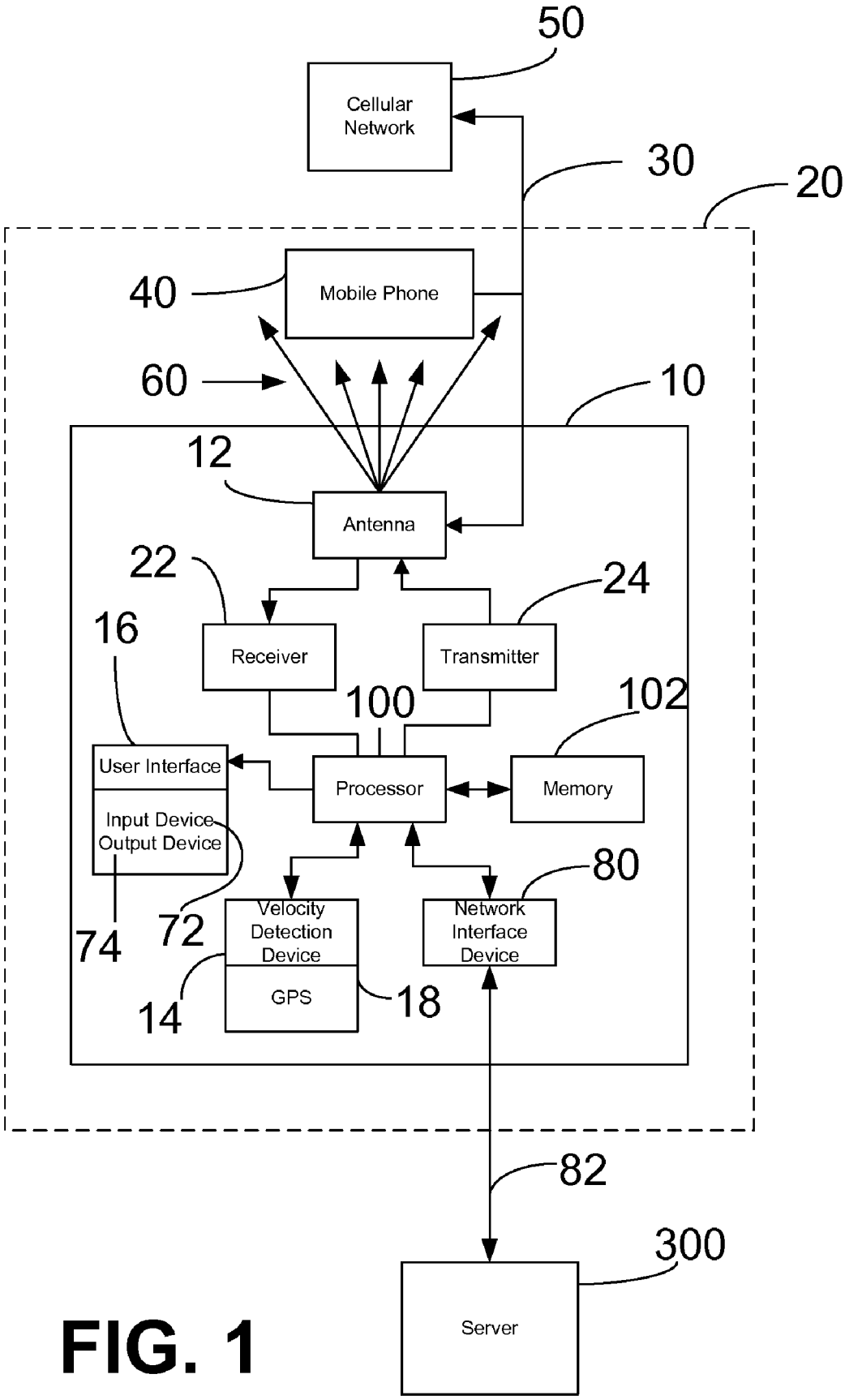
FIG. 1 is a schematic view of an example embodiment of a mobile phone detection and interruption system.

Referring now to the drawings and particularly to FIG. 1, there is shown therein a schematic view of a mobile phone signal detection and interruption system 10 operative for use in a vehicle 20.

In this described example, the system 10 may be mounted in a location (in the vehicle) that is operative to enable the system to both: detect different types of mobile phone communications 30 carried out by a mobile phone 40 in the vehicle and a cellular network 50; and transmit different types of blocking signals 60 capable of fully stopping and/or at least degrading the communications 30 between the mobile phone and a cellular network. Such mobile phone communications 30 may include voice communications, text messages, or any other type of mobile phone call, or electronic communication capable of being carried out between a mobile phone and a cellular network.

As shown in FIG. 1, the system may include a mobile phone communication receiver device 22 capable of receiving the different types of mobile phone communications 30. Also, the system may include a mobile phone communication transmitter device 24 capable of transmitting the different types of blocking signals 60.

In an example embodiment, the system may include a common antenna 12 used to both detect mobile phone communications 30 and transmit blocking signals 60. However, it is to be understood that in alternative embodiments, the system may include at least one mobile phone communication detection antenna that is separate from at least one blocking signal transmission antenna.

In an example embodiment, such a system 10 may be mounted underneath a driver's seat in the vehicle and may be powered via a electrical connection to existing wiring in the car (e.g., 12V DC electrical connection extending to a power adjustable driver's seat). The antenna(s) may have a form that is/are capable of transmitting blocking signals substantially upwardly through the driver's seat, while minimizing the strength of blocking signals transmitted in a horizontal direction (e.g., through the sides of the vehicle). For example, the antenna may be adapted to transmit the blocking signals upwardly in directions that are substantially within 80 degrees of a vertical axis. However, it is to be understood that in alternative examples, the system 10 may include an antenna capable of outputting blocking signals in different patterns and directional angles. Further alternative examples of the system may place the antenna in other locations, such as in the dash of the vehicle or other position in the vehicle. Also, alternative systems with multiple antennas may place the antennas in different locations in the vehicle (e.g., the detection antenna may be mounted in the dash of the vehicle, while a blocking signal transmission antenna is mounted under the seat).

The example system 10 may also include a velocity detection device 14 capable of determining the velocity of the vehicle. In an example embodiment, such a velocity detection device may corresponds to a GPS (global positioning system) device 18 capable of determining velocity via signals received from GPS satellites. In other embodiments, other types of velocity detection devices may be used such as a device that detects velocity via movement relative to different cell towers in a cellular network, or a device that detects accelerations, decelerations, vibrations, and/or bumps in the vehicle that are indicative of a moving vehicle.

In an example embodiment, the receiver device 22 may be capable of detecting the presence of mobile phone communication and may be capable of blocking such communication across a wide range of frequencies such as between 600 MHz to 2500 MHz to enable detection and blocking of CDMA, GSM, DCS, PCS PHS, IDEN, 3G and/or other types of radio frequency (RF) communications.

An example embodiment of the system 10 is operative to transmit blocking signals 60 responsive to at least one of: the detection by the system of mobile phone communication 30 in the vehicle; and the determined velocity of the vehicle. Further, an example embodiment of the system may include a user interface 16 capable of enabling a user to select from among different configurations for how the device should operate in response to one or more velocity levels.

Such a user interface may include at least one input device 72 capable of allowing the user to configure the system. Such input devices may include buttons, switches, knobs, keys, a touch sensitive membrane, or any other type of input device that is capable of capturing user provided information and selections for use with operating the system.

In an example embodiment, the input devices themselves (such as switches or knobs) may move to different marked positions on the system, which visually describe the operation of the input device in those positions. Also, in such embodiments or alternative embodiments, the user interface may include at least one output device 74 capable of displaying information regarding the operation of the system. For example, such an output device may include one or more LCDs, LEDs or other types of display devices capable of displaying information regarding the current configuration of the system. Also, such an output device may provide additional information such as information which guides a user through the configuration of the system. In addition, the output device may be capable of providing information regarding the operation of the system such as information corresponding to: the strength of a detected mobile phone communication 30; the velocity of the vehicle; and/or the current status of the transmission of a blocking signal from the system.

In an example embodiment, the system may include the capability of transmitting different types of blocking signals. Such different types of blocking signals may include a first type that corresponds to a periodic interrupting RF output signal that introduces static, white noise, and/or causes silence in the mobile phone communication 30 for a limited amount of time (e.g., 10 seconds) at known or random intervals (e.g., every 30 seconds). The periodic output of such an interrupting RF signal may permit a mobile phone call to continue (e.g., does not cause a dropped call), but makes the conversation sufficiently degraded so that the user is encouraged to avoid using the mobile phone while driving.

Further, such different types of blocking signals may include a second type that corresponds to a full interrupting RF output signal that continually introduces static, white noise, and/or causes silence in the mobile phone communication 30 for a sufficient amount of time (e.g., 30 seconds) to force the mobile phone and/or cell phone network to stop (e.g. disconnect or drop) the phone call being made or attempted to be made. In example embodiments, the periodic and full interrupting RF output signals may have the same frequency, amplitude, waveform and/or other signal characteristics except for one being periodic so as to not cause a dropped call, and the other being continuous for at least a duration of time that cases a dropped call. However, in other embodiments, the periodic and full interrupting RF output signals may each have different frequency, amplitude, waveform and/or other signal characteristics.

In addition to these described types of blocking signals, it is to be understood that example embodiments may employ other types of blocking signals that achieve full or partial blocking of a mobile phone communication to achieve either a full disconnection of the phone call or at least degraded communication.

In an example embodiment, the system may be configurable (such as through operation of the user interface) to specify under what circumstances the different types of blocking signals are transmitted. For example, the system may include user configurable settings that specify when to trigger the different types of blocking signals responsive to different velocities of the vehicle detected by the system.

As shown in FIG. 1, the system may include at least one processor 100 in operative connection with at least one memory device 102, the user interface 16, the velocity detection device 14, the receiver device 22, and the transmitter device 24. The processor 100 may be operatively configured through software/firmware to control and/or receive inputs from the various components/devices of the system.

The memory device 102 may correspond to a flash memory, or other storage device that is capable of storing user configurable settings inputted by a user through operation of an input device of the system. As shown in FIG. 2, in an example embodiment, such a memory may include information stored therein representative of a plurality of blocking signal types 200 correlated with user configurable velocity levels 220 (e.g. velocity thresholds and/or velocity ranges). Such blocking signal types may include the absence of blocking signals (referred to herein as a "No Blocking" type). Such blocking signal types may also include the periodic or full interrupting RF output signals discussed previously (respectfully referred to herein as a "Periodic Blocking" type or a "Full Blocking" type). Such blocking signal types may also include any other type of blocking signal capable of being transmitted by the system. Each of these different types of blocking signal types may be associated in the memory with a velocity level 220 for the vehicle which triggers the output of the associated blocking signal. As used herein a velocity level may correspond to a single velocity threshold. Also a velocity level may correspond to a range of velocities.

For example as shown in FIG. 2, a "No Blocking" type 200 is associated in the memory 102 with a velocity level of <15 miles/hour. The processor 100 of the system is responsive to this information in the memory such that when the velocity of the vehicle as detected by the GPS of the system is determined to be less than 15 miles/hour, the system is operative to forgo transmitting a blocking signal.

In another example as shown in FIG. 2, a "Periodic Blocking" type 200 is associated in the memory 102 with a velocity of level of 15 miles/hour to 25 miles/hour. The processor 100 of the system is responsive to this information in the memory such that when the velocity of the vehicle as detected by the GPS of the system is determined to be between 15 and 25 miles/hour (and mobile phone communication is detected in the vehicle), the system is operative to transmit the previously described periodic interrupting RF output signal. The system may cease transmitting the periodic interrupting RF output signal, when the system ceases to detect cellular communication in the vehicle.

Also, in another example as shown in FIG. 2, a "Full Blocking" type 200 is associated in the memory 102 with a velocity level of greater than 25 miles/hour. The processor 100 of the system is responsive to this information in the memory such that when the velocity of the vehicle as detected by the GPS of the system is determined to be greater than 25 miles/hour (and mobile phone communication is detected in the vehicle), the system is operative to transmit the previously described full interrupting RF output signal. The system may cease transmitting the full interrupting RF output signal, after a sufficient amount of time to cause the call to be dropped (e.g. 30 seconds). If cellular communication is again detected immediately after the blocking signal has finished, the system may be operative to retransmit the full interrupting RF output signal for a greater amount of time and/or at a greater power level.

In embodiments, the stored velocity levels are user configurable though operation of an input device of the system. For example the system may enable the user to configure each of the individual velocities levels from between 0 and 120 miles/hour in the memory of the system for use with triggering when to output different respective types of blocking signals.

In embodiments, the system may include user configurable settings stored in the memory of the system which specify whether to trigger outputting the "Full Blocking" and/or other types of blocking signals, based on either one of or both of the velocity of the vehicle and the detection of mobile phone communication in the vehicle. For example, the system may permit a user to specify that the "Full Blocking" type signal is associated with a velocity level of greater than zero miles/hour (or a higher velocity level) without requiring prior detection of mobile phone communication. Such a setting may cause the system to begin outputting a continuous interrupting RF output signal whenever the vehicle is in motion (or when a higher velocity threshold is reached) without first requiring detection of mobile phone communication. When the vehicle velocity falls back to zero (or falls below the higher velocity threshold) the "Full Blocking" type signal may be discontinued. Such a configuration of the system may be operative to prevent a user from sending text messages while the vehicle is moving at a velocity above zero miles/hour (or high velocity threshold).

The previously described memory 102 may correspond to a rewritable flash type memory or other type of computer accessible memory in operative connection with the processor 101. However, it is to be understood that the memory 102 may also include other types of devices such as one or more DIP switch or other electrical/mechanical devices that are capable of being configured to represent different settings. For example, the system may include a set of DIP switches or other mechanical dials or switches for each different blocking signal type. Different configurations of the respective switch or dial may correspond to a different velocity level or range of velocities for the respective blocking signal type.

Alternative embodiments of the described system may be used outside of vehicles, such as in prisons, casinos, and/or any other location that requires blocking of mobile phone communications. For example, in a prison environment, embodiments of the described system may be located in individuals prison cells, groups of prison cells, prison common areas, and other locations within the prison in which mobile phone use is prohibited by prisoners.

In these environments, the velocity detection device described previously may be omitted from the system, remain unused, or be turned off via a user configurable setting on the system. Thus the output of a blocking signal may be triggered responsive to detection of mobile phone communication and not the velocity at which the system is moving.

Also, the system may include features not typically applicable in a vehicle environment. For example, as shown in FIG. 1, the system may include a wireless and/or wired network interface device 80 in operative connection with the processor 100. The network interface device 80 may be capable of being used to provide a network connection 82 between the system and a remote server 300. With a wired network connection 82, the system may be operative to receive power through the network such as via a Power over Ethernet cable. The system may also include a transformer to enable the system to use 120 volt 60 Hz AC or other type of power source.

Upon detection of mobile phone communication in a prison cell, the device may be capable of accessing the remote server 300 through use of the network interface device 80 and provide information usable by the server to identify the location of the system. In this described example, the server 300 may be configured to monitor a plurality of the described systems 10, mounted in different locations throughout the prison. In response to receiving a notification of mobile phone use from one of the systems, the server may be operative to identify the particular system providing the notification, and to output an alarm indicative of mobile phone use in the identified prohibited area. To identify each system, the server may be operative to store in a data store, information which correlates unique identifying information provided by each system (e.g., an identification number, MAC address, and/or IP address) to the respective location of the systems in the building/prison. The systems themselves may be operative to provide the unique identifying information to the server upon detection of mobile phone use.

In addition, the server may be operative to provide a confirmation to a system, that the notification of mobile phone use was received by the server. Upon receipt of such a confirmation, the system may be operative to commence outputting of a blocking signal to prevent further use of the mobile phone in the prison cell or other prohibited location.

In this described embodiment or other embodiments, the system may be configurable as to the particular blocking frequency ranges that are outputted. For example, in a prison environment, the prison staff may use a particular communication device with a specific frequency range that should not be jammed by the system. An example system may be configurable to select which range or ranges of frequencies of blocking signals to be transmitted from the system, so as to avoid interrupting communications intended to remain available for use by prison staff.

An example embodiment of the system may include a default set of features applicable to many different applications of the system (e.g., vehicles and prisons). Such a default set of features may include the previously described antenna 12, receiver device 22, and transmitter device 24. Other features such as the velocity detection device 14 and/or the network interface device 80 may be optional components that are in removable connection with the system such as via a USB bus, PC card slot, or other connection with the processor 100 that allows the system to be upgraded (or downgraded) for different applications.

In an example embodiment, the system may include a battery operative to power the system in environments that do not include an available external power source. After a predetermined amount of time, the system may be operative to enter a sleep mode in which no battery power or at least a sustainably reduced amount of battery power is used to operate portions of the electronics of the system. In this described embodiment, the antenna 12 may include a passive antenna configured to generate a signal from a sufficiently strong mobile phone communication 30, which generated signal is sufficiently strong to power a circuit in the system that awakes the system from the sleep mode. After being awakened from the sleep mode, the system may then begin operating using power from the battery to carry out one or more of the previously described functions of example embodiments of the system. Such functions for example that occur when the system is awakened from the sleep mode (but which do not occur during the sleep mode) include transmit a notification to a server operative to generate an appropriate alarm representative of the presence of cell phone use.

In this described embodiment, the system may include stored in a memory or other article of the system; any needed software, firmware and/or device drivers applicable for use by the processor 100 with controlling the default and optional components. Also, in further embodiments, the system may be capable of being updated with new software, firmware and/or device drivers from a USB flash drive and/or from a server computer operating software capable of communicating updated software/firmware instructions to the system via the network connection 82. Such software operating on the server computer may also be operative to provide a user interface capable of being used to configure the system through the network connection 82.

Computer executable software/firmware instructions used in operating processors in the described systems to cause the systems to carry out the described functions and/or steps may be loaded/read from computer readable media or articles of various types into the processors. Such software/firmware may be included on and loaded from one or more articles such as compact disks, DVDs, other optical media, hard disk drives, other magnetic media, flash memory devices, and/or other read-only or rewritable drives and storage devices.

Thus the new mobile phone detection and interruption system and method achieves one or more of the above stated objectives, eliminates difficulties encountered in the use of prior devices and systems, solves problems and attains the desirable results described herein.

In the foregoing description certain terms have been used for brevity, clarity and understanding; however, no unnecessary limitations are to be implied therefrom, because such terms are used for descriptive purposes and are intended to be broadly construed. Moreover, the descriptions and illustrations herein are by way of examples, and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. An apparatus comprising:

a system comprising:

at least one processor;

a velocity detection device in operative connection with the at least one processor;

a transmitter device in operative connection with the at least one processor;

a receiver device in operative connection with the at least one processor, wherein the receiver device is in operative connection with at least one antenna;

a memory in operative connection with the at least one processor, wherein the memory includes stored therein data representative of at least one velocity level, wherein the at least one processor is operative to cause the transmitter device to respectively output a plurality of different respective types of wireless interrupting radio frequency (RF) output signals responsive at least in part to different respective velocities detected with the velocity detection device, wherein the different types of wireless interrupting RF output signals include a first type of wireless interrupting RF output signal that interrupts a mobile phone call associated with a mobile phone communication between a mobile phone and a cellular network while enabling the mobile phone call to continue, wherein the different types of wireless interrupting RF output signals include a second type of wireless interrupting RF output signal that causes the mobile phone call to be dropped by at least one of the mobile phone and the cellular network, wherein the at least one processor is responsive at least in part to the receiver device detecting with the at least one antenna at least one mobile phone communication and to the velocity detection device detecting a velocity that is less than the at least one velocity level, to cause the transmitter device to output the first type of wireless interrupting RF output signal, wherein the at least one processor is responsive at least in part to the receiver device detecting with the at least one antenna at least one mobile phone communication and to the velocity detection device detecting a velocity that is greater than the at least one velocity level, to cause the transmitter device to output the second type of wireless interrupting RF output signal.

2. The apparatus according to claim 1, wherein the first type of wireless interrupting RF output signal causes at least one of static, noise, and silence to be included in the mobile phone call.

3. The apparatus according to claim 1, further comprising:

a vehicle, wherein the system is mounted inside the vehicle.

4. The apparatus according to claim 3, wherein the vehicle includes a seat and an electrical connection with the seat, wherein at least a portion of the system is mounted under the seat and is in operative connection with the electrical connection with the seat.

5. The apparatus according to claim 1, wherein the system further includes at least one input device, wherein the at least one processor is operative to change the at least one velocity level stored in the memory responsive at least in part to at least one input received through operation of the at least one input device.

6. A method comprising:

a) through operation of a receiver device in a vehicle, wirelessly detecting with at least one antenna, at least one mobile phone communication from a mobile phone in the vehicle to a cellular network;

b) through operation of a velocity detection device in the vehicle, detecting a first velocity, wherein the velocity detection device and the receiver device are in operative connection with at least one processor in the vehicle, wherein the at least one processor is in operative connection with a memory, wherein the memory includes stored therein data representative of at least one velocity level, wherein the at least one processor is operative to cause a transmitter device in operative connection with the at least one processor to respectively output a plurality of different respective types of wireless interrupting radio frequency (RF) output signals responsive at least in part to different respective velocities detected with the velocity detection device;

c) through operation of the at least one processor, causing the transmitter device in the vehicle to output a first type of wireless interrupting RF output signal that causes at least one interruption of a mobile phone call associated with the mobile phone communication while enabling the mobile phone call to continue, responsive at least in part to (a) and the at least one processor determining that the first velocity detected in (b) is less than the at least one velocity level stored in the memory;

d) through operation of the velocity detection device, detecting a second velocity, wherein the second velocity is greater than the first velocity; and e) through operation of the at least one processor, causing the transmitter device to output a second type of wireless interrupting RF output signal that causes the mobile phone call to be dropped by at least one of the mobile phone and the cellular network, responsive at least in part to the processor determining that the second velocity detected in (d) is greater than the at least one velocity level stored in the memory.

7. The method according to claim 6, wherein in (b) the first type of wireless interrupting RF output signal causes at least one of static, noise, and silence to be included in the mobile phone call.

8. The method according to claim 6, further comprising:

f) through operation of the at least one processor changing the at least one velocity level stored in the memory responsive to at least one input received through operation of an input device in operative connection with the at least one processor.

9. Non-transitory computer readable media including computer executable instructions operative to cause at least one processor in a system in a vehicle to cause the system to carry out a method comprising:

a) through operation of a receiver device in the vehicle, wirelessly detecting with at least one antenna, at least one mobile phone communication from a mobile phone in the vehicle to a cellular network;

b) through operation of a velocity detection device in the vehicle, detecting a first velocity, wherein the velocity detection device and the receiver device are in operative connection with the at least one processor in the vehicle, wherein the at least one processor is in operative connection with a memory, wherein the memory includes stored therein data representative of at least one velocity level, wherein the at least one processor is operative to cause a transmitter device in operative connection with the at least one processor to respectively output a plurality of different respective types of wireless interrupting radio frequency (RF) output signals responsive at least in part to different respective velocities detected with the velocity detection device;

c) through operation of the at least one processor, causing the transmitter device in the vehicle to output a first type of wireless interrupting RF output signal that causes at least one interruption of a mobile phone call associated with the mobile phone communication while enabling the mobile phone call to continue, responsive at least in part to (a) and the at least one processor determining that the first velocity detected in (b) is less than the at least one velocity level stored in the memory;

d) through operation of the velocity detection device, detecting a second velocity, wherein the second velocity is greater than the first velocity; and e) through operation of the at least one processor, causing the transmitter device to output a second type of wireless interrupting RF output signal that causes the mobile phone call to be dropped by at least one of the mobile phone and the cellular network, responsive at least in part to the processor determining that the second velocity detected in (d) is greater than the at least one velocity level stored in the memory.

* * * * *